US007386945B2

(12) United States Patent
Burgess

(10) Patent No.: US 7,386,945 B2
(45) Date of Patent: Jun. 17, 2008

(54) SOLE FOR INCREASED CIRCULATION

(75) Inventor: Ian Burgess, Canton, MA (US)

(73) Assignee: Reebok International Ltd., Canton, MA (US)

( * ) Notice: Subject to any disclaimer, the term of this patent is extended or adjusted under 35 U.S.C. 154(b) by 169 days.

(21) Appl. No.: 10/696,555

(22) Filed: Oct. 30, 2003

(65) Prior Publication Data

US 2005/0091881 A1 May 5, 2005

(51) Int. Cl.
*A43B 7/06* (2006.01)

(52) U.S. Cl. ..... 36/3 R; 36/3 B

(58) Field of Classification Search ..... 36/141, 36/91, 95, 103, 107, 7.6, 28, 29, 30 R, 31, 36/3 R, 3 A, 3 B
See application file for complete search history.

(56) References Cited

U.S. PATENT DOCUMENTS

| | | | | | |
|---|---|---|---|---|---|
| 614,688 | A | | 11/1898 | Barber | |
| 2,082,537 | A | | 6/1937 | Butler | |
| 2,284,930 | A | * | 6/1942 | Stoker | 36/30 R |
| 3,010,229 | A | | 11/1961 | Snitzer | |
| 3,834,046 | A | * | 9/1974 | Fowler | 36/28 |
| 4,439,937 | A | | 4/1984 | Daswick | |
| 4,733,483 | A | * | 3/1988 | Lin | 36/28 |
| 4,815,221 | A | | 3/1989 | Diaz | |
| 4,930,231 | A | * | 6/1990 | Liu | 36/30 R |
| 5,035,068 | A | * | 7/1991 | Biasi | 36/3 R |
| 5,255,451 | A | | 10/1993 | Tong et al. | |
| 5,367,791 | A | | 11/1994 | Gross et al. | |
| 5,473,827 | A | | 12/1995 | Barre et al. | |
| 5,619,809 | A | * | 4/1997 | Sessa | 36/3 R |
| 5,699,627 | A | | 12/1997 | Castro | |
| 5,720,118 | A | | 2/1998 | Mayer et al. | |
| 6,076,282 | A | * | 6/2000 | Brue' | 36/141 |
| 6,090,013 | A | | 7/2000 | Eschenbach | |
| 6,199,304 | B1 | * | 3/2001 | Ludemann | 36/44 |
| 6,508,015 | B1 | * | 1/2003 | Rauch | 36/30 R |
| 6,874,251 | B2 | * | 4/2005 | Moretti | 36/29 |
| 2002/0184793 | A1 | * | 12/2002 | Sato | 36/30 R |

OTHER PUBLICATIONS

S. Wallenfels, "Innovation Machine," *Club Business International Magazine*, pp. 72, 73, 75 and 77 (Oct. 2000).

(Continued)

*Primary Examiner*—Marie Patterson
(74) *Attorney, Agent, or Firm*—Sterne, Kessler, Goldstein & Fox P.L.L.C.

(57) ABSTRACT

A sole for a shoe to increase circulation in the wearer's foot during forefoot intensive activities. The sole includes a midsole having at least one protrusion disposed in a forefoot region thereof and a plate having at least one receptacle disposed therein wherein the plate is fixedly attached to the midsole such that the receptacle aligns with the protrusion. The diameter of the receptacle is approximately equal to the diameter of the protrusion, so that the protrusions flex within the receptacles in a trampoline-like fashion. An outsole is fixedly attached to the plate and the midsole, wherein the outsole is disposed underneath the entire length of the sole. A forefoot region of the outsole includes an exterior portion and a softer interior portion. Several projections are disposed on the softer interior portion to provide additional pressure points in the sole.

27 Claims, 11 Drawing Sheets

OTHER PUBLICATIONS

S.W., "A New Category is born: The Elliptical Motion Machine," *Club Business International Magazine*, p. 78 (Oct. 2000).

"Elliptical Innovators," *Club Business International Magazine*, pp. 80 and 83 (Oct. 2000).

H. Asai, et al., "A Study of the Effect of Heelless shoes on the Plantar Peripheral Circulation Based on the Thermogram," *Memoirs of Osaka Kyoiku University Ser. III*, vol. 44, No. 2, pp. 237-250 (Feb. 1996) from internet site http://www.i-rok.com/articles/6article.htm (Jun. 15, 2003).

M. Besser, et al., "Treadmill v. Overground Walking: A Comparison of Plantar Pressures," Human Performance Laboratory, Department of Physical Therapy, Thomas Jefferson University, Philadelphia, PA, date unknown.

* cited by examiner

SOLE FOR INCREASED CIRCULATION

BACKGROUND OF THE INVENTION

1. Field of the Invention

The field of this invention generally relates to footwear, and more particularly to an article of footwear having a multi-layered sole for stimulating circulation during forefoot intensive activities by allowing for vertical flexion and massaging the wearer's foot.

2. Background of the Invention

Indoor exercise machines are a popular and convenient way for many people to obtain or maintain cardiovascular fitness. Many of these machines, such as elliptical trainers, stair climbers, and stationary bicycles, utilize pedals that hold a user's feet stationary. As such, intense pressure is borne by the forefoot for the duration of the workout. Similar pressures are also experienced in other repetitive, forefoot intensive activities, such as step aerobics. Many users of such equipment experience pain, burning, tingling, or numbness in their feet. This phenomenon is called "transient paresthesia" (hereinafter, "TP"), also known more colloquially as "numb toe" or "sleepy feet". While the precise mechanism for causing TP is unknown, the pressure on the nerves of the feet and the pressure causing an interruption in blood flow circulation are strongly suspected. If unrelieved for extended periods, TP may develop into a more permanent numbness in the feet. At the very least, TP often causes the user to cut short or interrupt a workout to reduce these irritating sensations in the feet.

Users who experience TP may try several methods to prevent or relieve TP. One such method is wearing shoes with very stiff soles, which help to distribute more evenly the pressures on the foot. However, such shoes can be uncomfortable for use on an elliptical trainer. Another method used is to wear shoes having particularly stiff support in the arch region of the sole, which prevents the arch from collapsing. However, such arch support is only useful in preventing or reducing TP in a small number of wearers. Finally, some users wiggle their toes, lift their heels, or otherwise move their feet to increase circulation and redistribute pressure. Such manipulation of the feet while using exercise machines is not safe, however, as the foot could slip off of a pedal or out of a strap, thereby causing potentially severe injuries to the user.

Accordingly, needed in the art is a safe way to increase the circulation and/or dynamically redistribute pressure in the forefoot during forefoot intensive activities, such as while using an exercise machine.

SUMMARY OF THE INVENTION

Accordingly, disclosed herein is a sole for a shoe having a midsole having at least one protrusion disposed in a forefoot region thereof and a plate having at least one receptacle disposed therein wherein the plate is fixedly attached to the midsole such that the receptacle aligns with the protrusion. The diameter of the receptacle is approximately equal to the diameter of the protrusion, so that the protrusions flex within the receptacles in a trampoline-like fashion.

Also included in the sole is an optional outsole fixedly attached to the plate and the midsole, wherein the outsole is disposed along the entire length of the sole. A forefoot region of the outsole includes an exterior portion and a softer interior portion. Several projections are disposed on the softer interior portion to provide additional pressure points in the upper layers of the sole to assist in the vertical flexion thereof. Further, the softer interior portion may include at least one cutout to increase the flexibility and reduce the weight thereof.

BRIEF DESCRIPTION OF THE DRAWINGS/FIGURES

Features, aspects and advantages of the present invention will become better understood with reference to the following description, appended claims, and accompanying drawings, which are not to scale, wherein:

DETAILED DESCRIPTION OF THE INVENTION

Specific embodiments of the present invention are now described with reference to the figures, where like reference numbers indicate identical or functionally similar elements.

Figure 1:
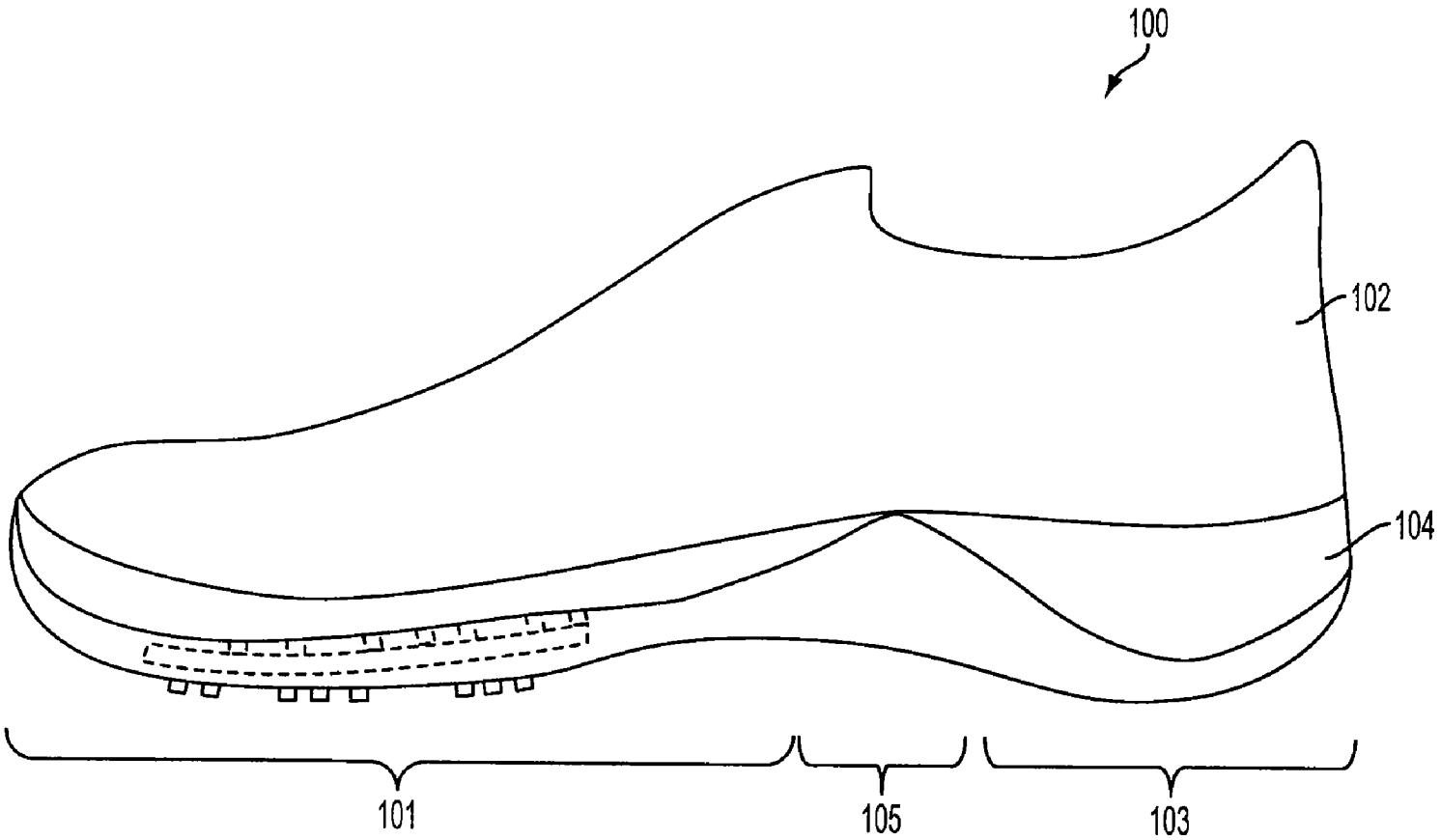
FIG. 1 illustrates a side view of a shoe including a sole according to the present invention.

Referring now to FIG. 1, a shoe 100 including an upper 102 and a sole 104 is shown. Shoe 100 may be any type of shoe known in the art, such as an athletic shoe, a dress shoe, or a sandal. Upper 102 may be made of any material appropriate for use as the upper of a shoe, such as leather, cloth, vinyl, or plastic. For the sake of convenience, a forefoot section 101, a rearfoot or heel section 103, and an arch region 105 are also shown.

Figure 2:
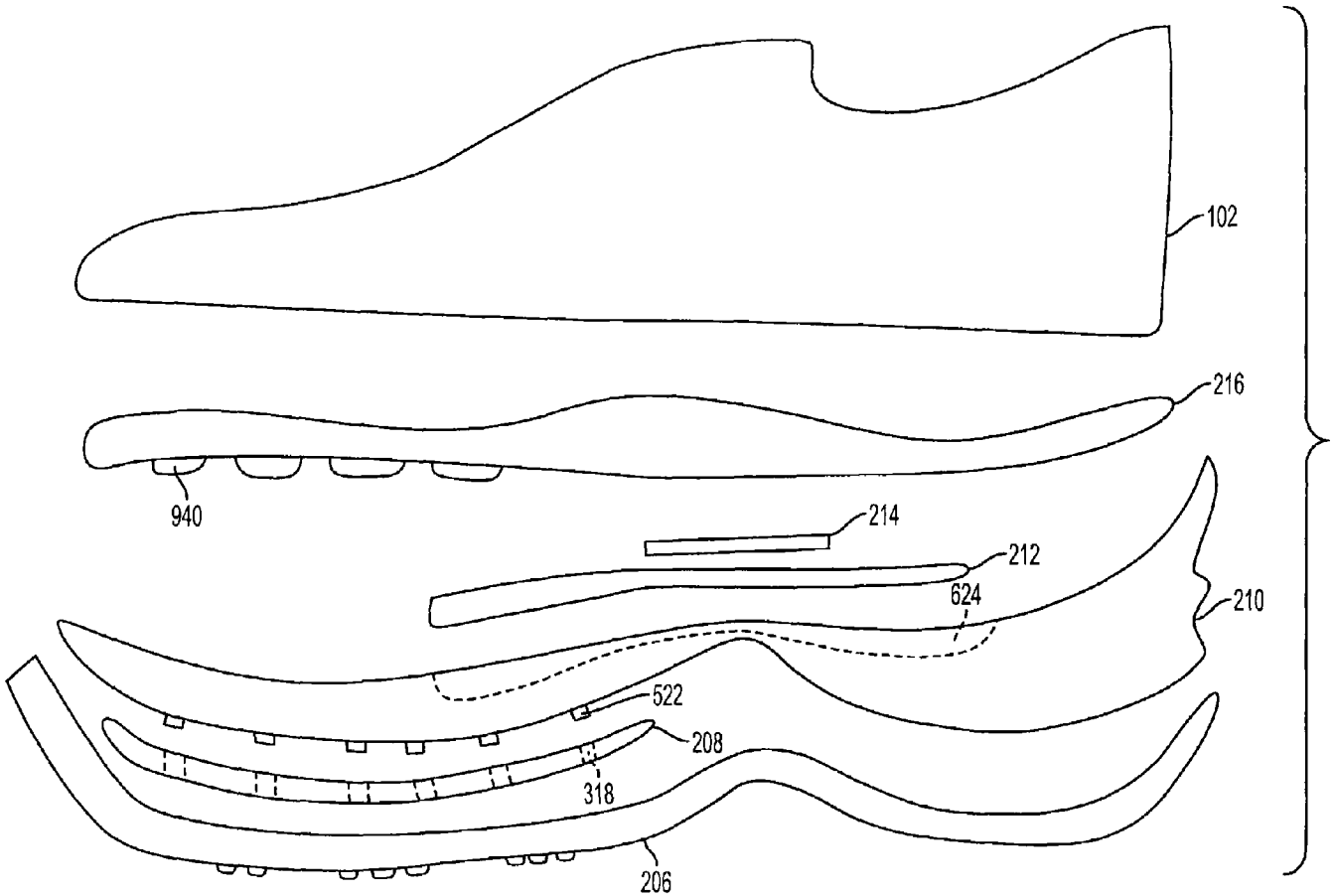
FIG. 2 is an exploded side view of the sole of FIG. 1.

Referring now to FIG. 2, sole 104 is shown to include several layers. A midsole 210 forms one layer of sole 104. Midsole 210 is disposed vertically above outsole 206, an is generally coextensive therewith. Midsole 210 is similar to other midsoles known in the art, where the function thereof is to cushion the foot during the step. As such, the characteristics of midsole 210 will vary according to the intended use of shoe 100. For example, midsole 210 will be relatively thick and resilient in an athletic shoe, while midsole 210 will be relatively thin in a dress shoe. Midsole 210 may be made from any material known in the art that is appropriate for a midsole, such as ethyl vinyl acetate (EVA), either injection, poured, or compression molded, rubber, polyurethane (PU) foam, or thermoplastic urethane (TPU). For the purposes of example only, in one embodiment shoe 100 is an athletic shoe. Midsole 210 in this embodiment is made from compression molded EVA, having a durometer measurement between 48 and 61° on an Asker C scale. Additionally, the hardness of midsole 210 may vary along the length thereof, such as between forefoot 101 and rearfoot 103. For the purposes of example only, in one embodiment, the midsole durometers meet 45±3° Asker C in forefoot 101 and 51±3° Asker C in rearfoot 103.

The thickness of midsole 210 in this embodiment varies lengthwise. For example, in one embodiment, forefoot 101 is approximately 6 mm, arch region 105 is slightly thinner than forefoot 101, and heel region 103 is approximately 15 mm. Other designs of shoe 100 will involve different dimensions depending on the material of midsole 210 and the amount of desired cushioning.

Figure 5:
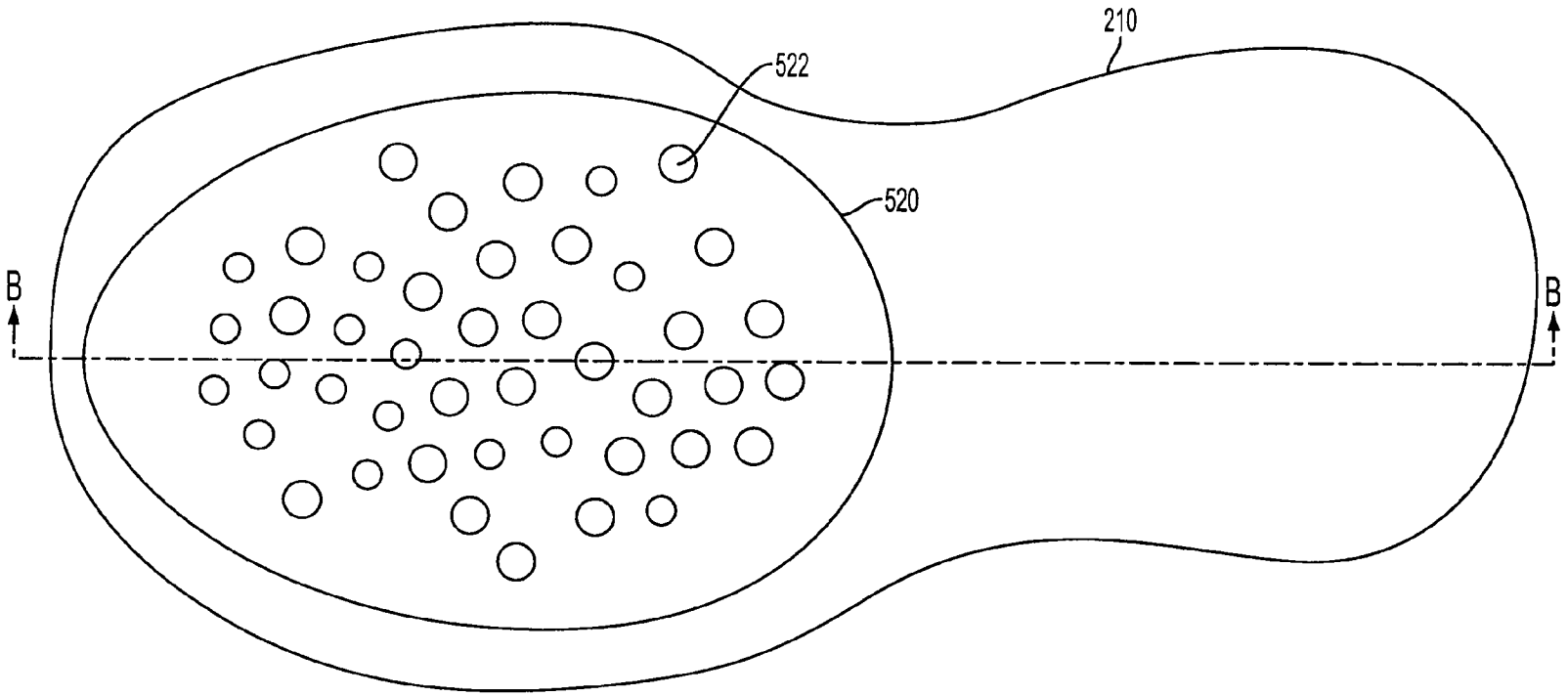
FIG. 5 illustrates a bottom view of a midsole of the sole of FIG. 1.

As shown in FIG. 5, a bottom surface of midsole 210, i.e., the surface of midsole 210 facing outsole 206, includes a cutout 520 disposed in the forefoot region. In this embodiment, a plurality of protrusions 522 extend outward from cutout 520, such that the lower surface of protrusions 522 approximately aligns with the remainder of the bottom surface, i.e., the outward-most surface, of midsole 210. In another embodiment, protrusions 522 may extend outward from an upper surface of midsole 210 (not shown).

The diameters of protrusions 522 range from 0.3 to 0.5 cm in diameter, although this may vary substantially. As will be recognized by those skilled in the art, protrusions 522 may be of varying sizes and numbers, for example, such that protrusions 522 extend beyond the plane of the outward-most surface of midsole 210 or only a single protrusion 522 is included. Further, in yet another embodiment, cutout 520 may be eliminated entirely, so that protrusions 522 extend directly from the bottom surface of midsole 210.

Figure 3:
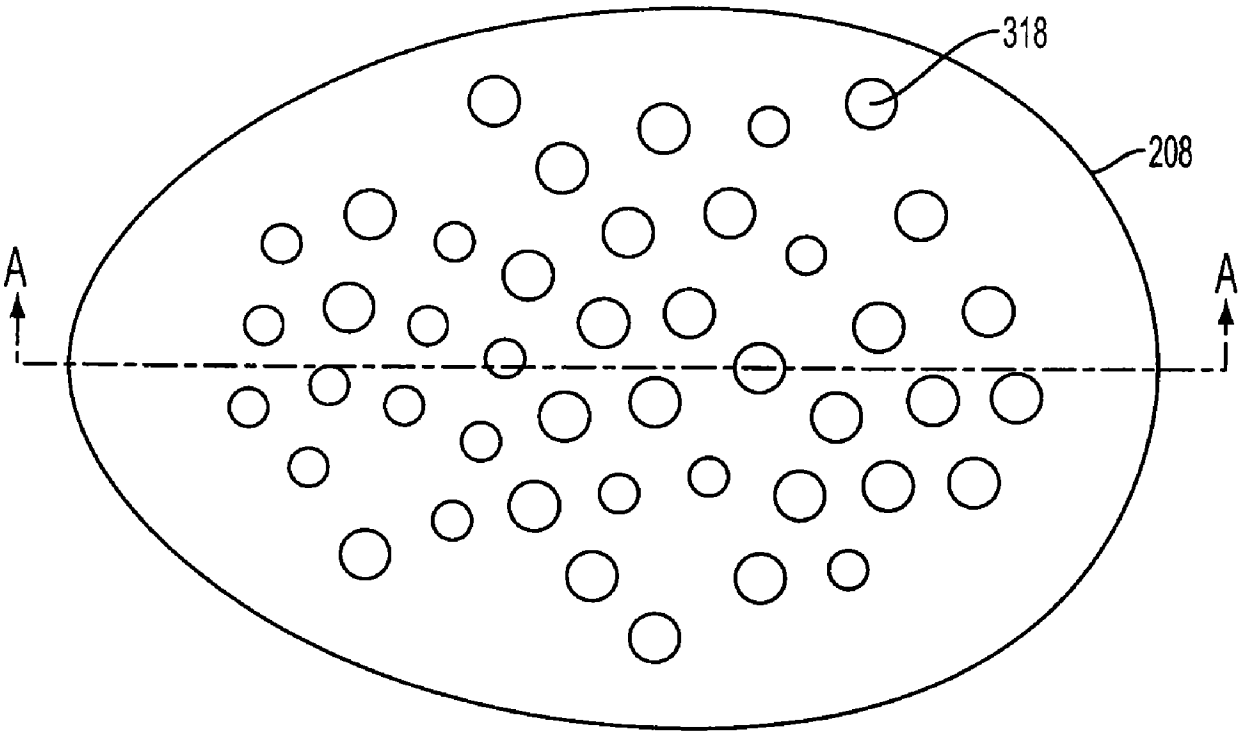
FIG. 3 illustrates a top view of a dispersion plate of the sole of FIG. 1.

Disposed in a forefoot region between midsole 210 and outsole 206 is a dispersion plate 208. Shown in greater detail in FIG. 3, dispersion plate 208 is of a size and shape to align with cutout 520. Dispersion plate 208 is a relatively thin, stiff plate with a plurality of receptacles 318 disposed therethrough. For example, in one embodiment dispersion plate 208 is a 1.5 mm thick injection molded TPU plate. Other thicknesses and similar materials, including composites, filled and non-filled nylons and similar structural plastics, impregnated and non-impregnated pressed fibre boards, and die cut sheet stock of various materials, may also be used.

Figure 4:
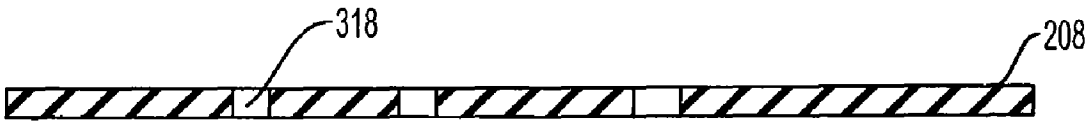
FIG. 4 is a cross-sectional view of the dispersion plate of FIG. 3, taken along line A-A thereof.

As shown in FIG. 4, a cross-sectional view of dispersion plate 206, receptacles 318 extend entirely through dispersion plate 208, i.e., receptacles 318 are holes through dispersion plate 208. In another embodiment, receptacles 318 may be cutouts or pockets that do not extend entirely through dispersion plate 208.

Dispersion plate 208 is fitted into cutout 520 such that receptacles 318 approximately align with protrusions 522. Receptacles 318 correspond generally in number and size with protrusions 522 on midsole 210. However, in one embodiment, receptacles 318 are of similar or slightly smaller diameter as protrusions 522, so protrusions 522 do not extend through receptacles 318. In one embodiment, after alignment with protrusions 522, dispersion plate 208 is fixedly attached to midsole 210 and/or outsole 206, such as with an adhesive, such as only around the perimeter of dispersion plate 208 or a more substantial portion of dispersion plate 208, or even in its entirety. However, receptacles 318 should not be filled with adhesive. In another embodiment, dispersion plate 208 is not fixedly attached to the other layers of sole 104, but is simply sandwiched between midsole 210 and a lower layer, such as outsole 206.

Dispersion plate 208 allows the forefoot region of midsole 210 to move a slight amount with respect to outsole 206. As a wearer puts pressure on the forefoot region of midsole, protrusions 522 press against dispersion plate 208. Consequently, a portion of each protrusion 522 extends into corresponding receptacle 318. However, as protrusion 522 has a similar or slightly larger diameter than receptacle 318, protrusion 522 is prevented from extending entirely through receptacle 318. The interaction of protrusions 522 with dispersion plate 208 and receptacles 318 produces a trampoline-like effect. This trampoline-effect is caused by the pressure of the foot on the midsole forcing protrusions 522 downward against dispersion plate 208 as well as pressure from the ground forcing dispersion plate 208 upwards against protrusions 522. As protrusions 522 are made of a somewhat flexible material, protrusions 522 bow into receptacles 318, thereby allowing for a small degree of vertical motion only in the vicinity of protrusions 522 with every step. This vertical motion imitates the minor manipulations of the foot recommended to increase circulation and relieve TP, as described above. However, with the present invention the foot doesn't actually have to shift on the pedals of the exercise machine, thereby reducing the possibility of accidental injury.

As will be recognized by those skilled in the art, as the thickness of dispersion plate 208 increases, the amount of vertical motion will also increase. However, a very thick dispersion plate 208 makes sole 104 heavy or aesthetically displeasing. Therefore, a tradeoff between the desired degree of vertical motion and the weight/aesthetics of sole 104 is necessary.

Figure 6:
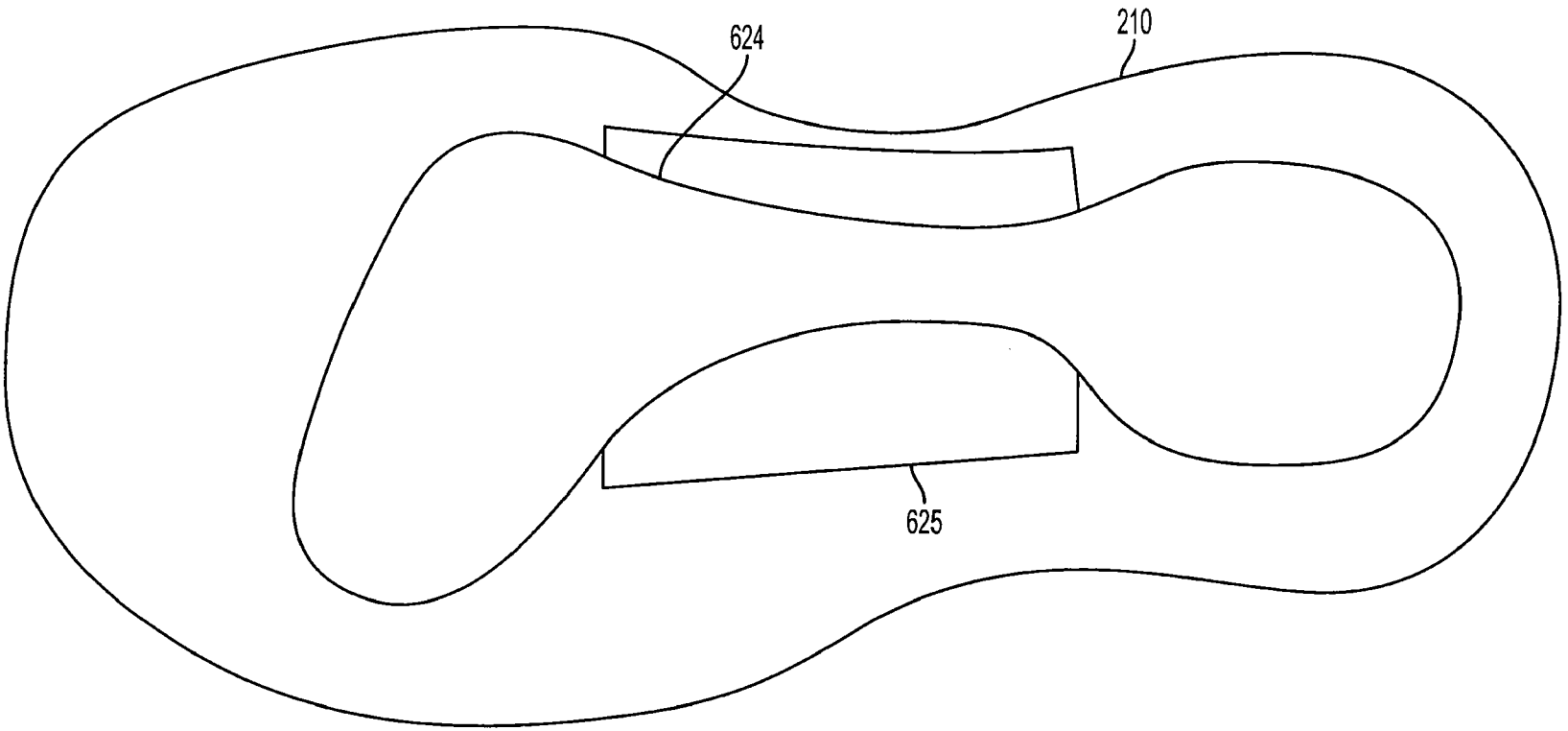
FIG. 6 illustrates a top view of the midsole of FIG. 5.
Figure 6A:
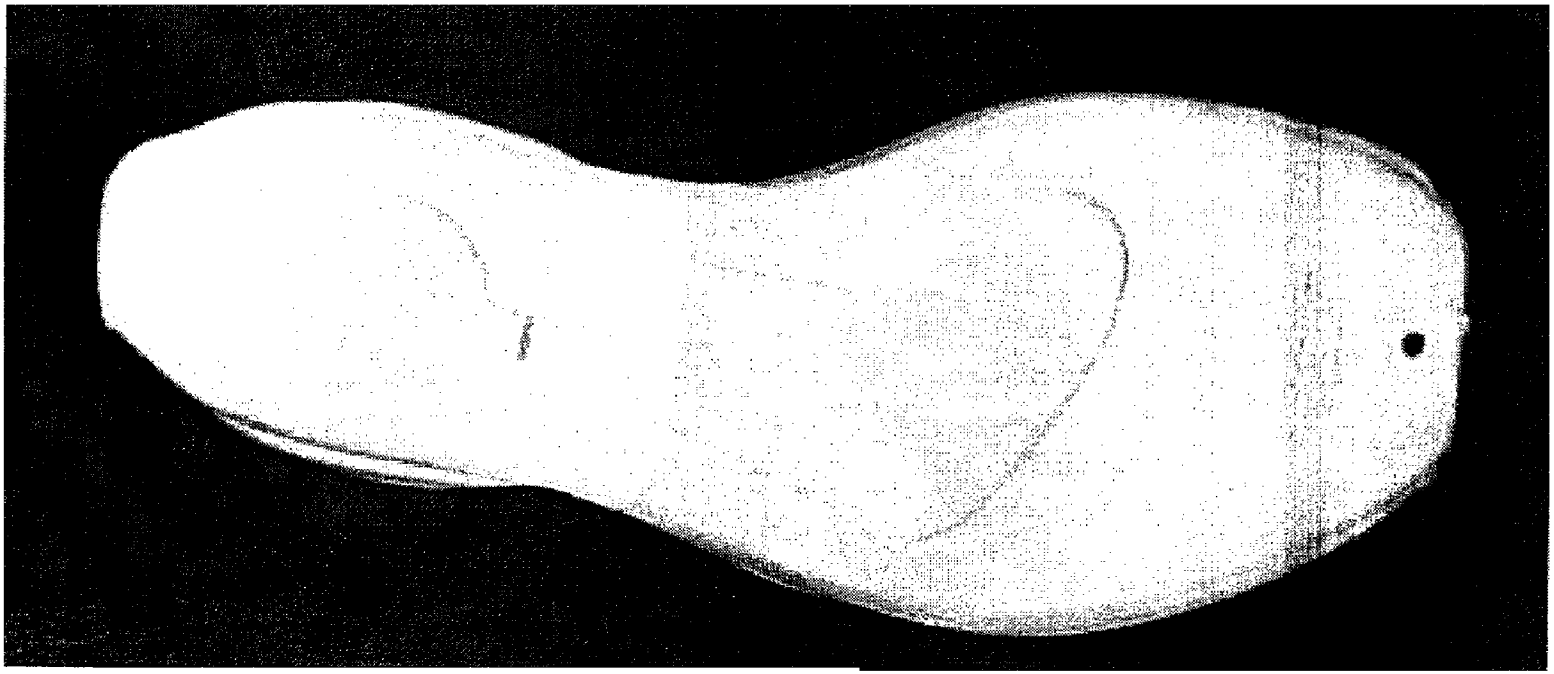
FIG. 6A is a top view photograph of the midsole of FIG. 6.
Figure 8:
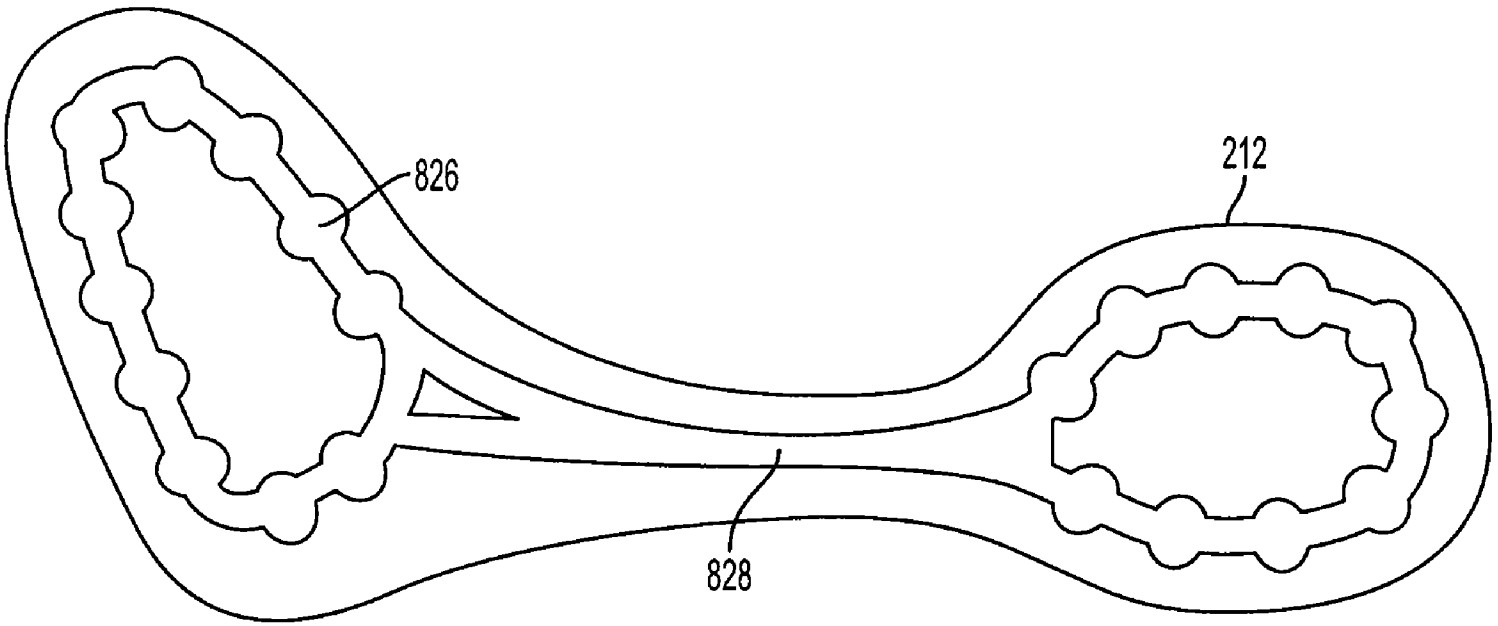
FIG. 8 illustrates a bottom view of a foam insert of the sole of FIG. 1.

Referring now to FIG. 6, a top view of midsole 210, a second cutout 624 is shown. Second cutout 624 is of a size and shape to accept therein an insert 212 for additional cushioning. Insert 212 is shown in greater detail in FIG. 8, which illustrates a bottom view of insert 212. Insert 212 is made from a cushioning material, such as PU foam with a durometer measurement between 45 and 50 on the Asker C scale, injected or compression-molded EVA, or blow-molded rubber with a similar durometer measurement. Insert 212 may include a system of pockets 826 and channels 828 to increase the flexibility thereof or to provide more dynamic cushioning with the movement of air through pockets 826 and channels 828 as pressure from the step varies the pressure along insert 212. In another embodiment, insert 212 may be eliminated entirely. In such an embodiment, second cutout 624 also would not be necessary.

Referring again to FIG. 6, a third cutout 625 is shown. Third cutout 625 is more shallow than second cutout 624, i.e., second cutout 624 and third cutout 625 have different depths. Third cutout 624 is of a size and shape to receive a plate 214 (shown in FIG. 2). Plate 214 is disposed within third cutout 624 between midsole 210 and a sockliner 216 (shown in FIG. 2). Plate 214 is a thin, stiff plate used to increase the stiffness of sole 104 in an arch region thereof, which helps to prevent the wearer's arch from collapsing. Plate 214 may be made of any suitable material, such as metal, compressed paper, bonded sheet, foam, plastics, or a combination of these materials. Plate 214 also serves to hold insert 212 in place.

Figure 7:
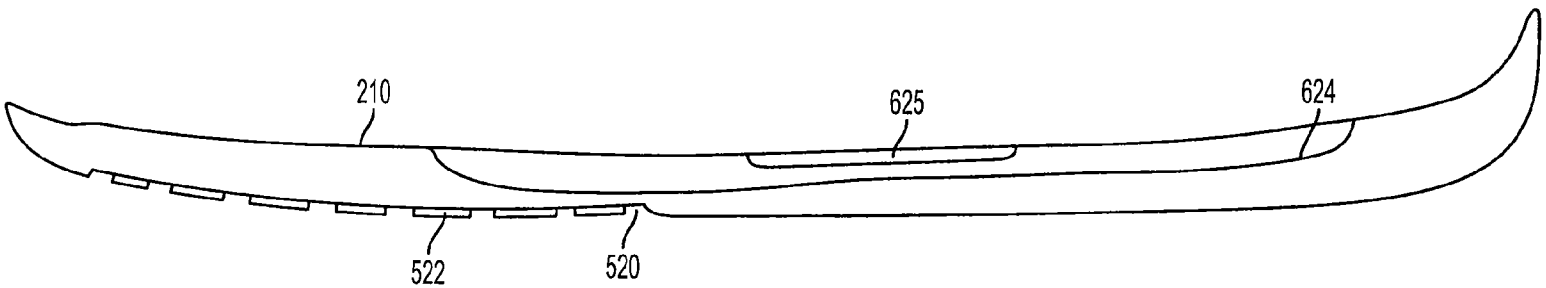
FIG. 7 is a cross-sectional view of the midsole of FIGS. 5 and 6.

FIG. 7 shows a cross-sectional view of midsole 210 taken along line B-B of FIG. 5. FIG. 7 shows the relative placement and thicknesses of cutouts 520 and 624.

Sockliner 216 provides the uppermost layer of sole 104. Sockliner 216 is made of a soft resilient material covered on an upper surface thereof with an abrasion-resistant, durable material to protect the resilient material from damage. The resilient material may be of any type known in the art for use as a sockliner, such as molded PU or similar materials. The durable material may also include absorbant properties for additional comfort for the wearer. The durable material may be any type known in the art, such as woven or pressed fabrics.

Figure 9:
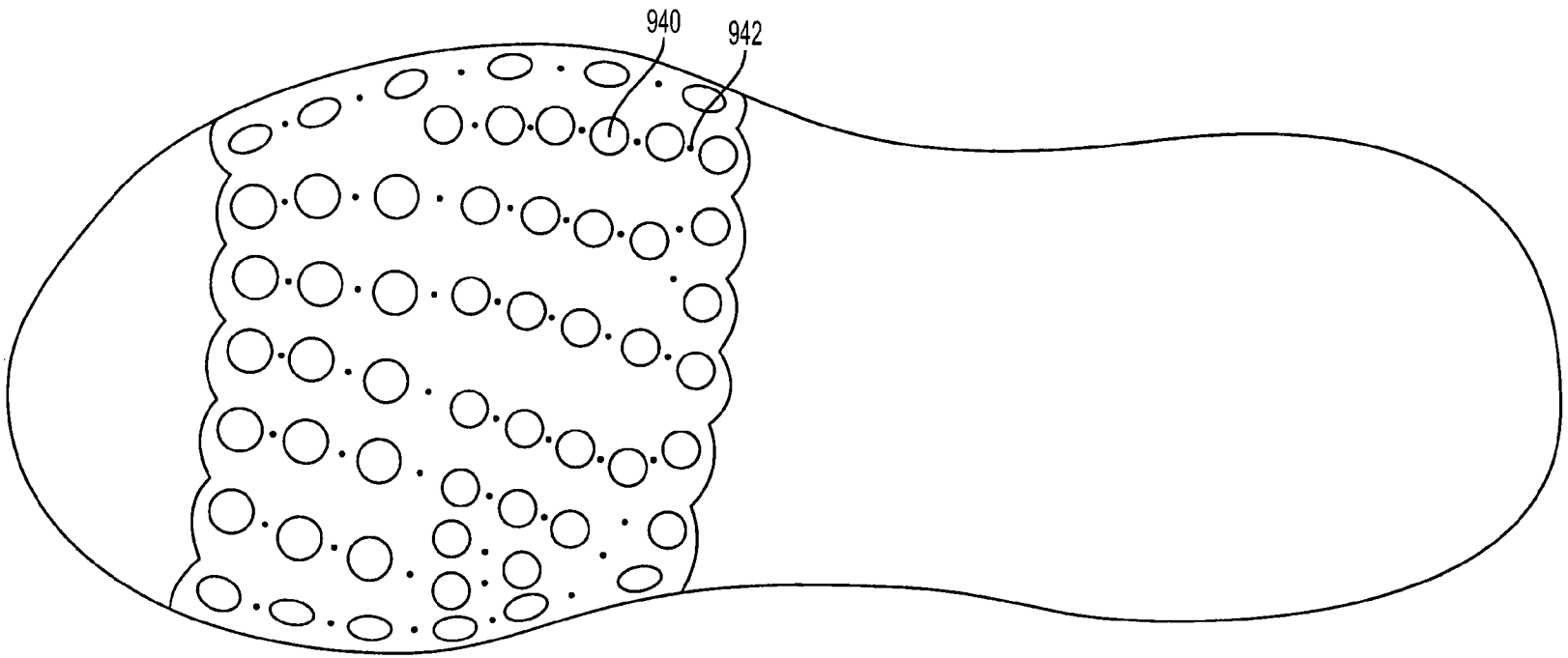
FIG. 9 illustrates a bottom view of a sockliner of the sole of FIG. 1.

Referring now to FIG. 9, several nubs 940 are shown extending downward from a bottom surface of sockliner 216. Nubs 940 abut against an upper surface of midsole 210. Nubs 940 provide a massaging effect on the bottom of the wearer's foot to increase blood flow and circulation in the foot to reduce fatigue thereof and pressure thereon. As the wearer applies pressure on the forefoot, nubs 940 are pressed against the upper surface of midsole 210. Nubs 940 will not deform to any significant degree due to this pressure as do protrusions 522, instead, nubs 940 are forced upwards so that the wearer can feel nubs 940 through the softer upper layers of sockliner 216.

Figure 10:
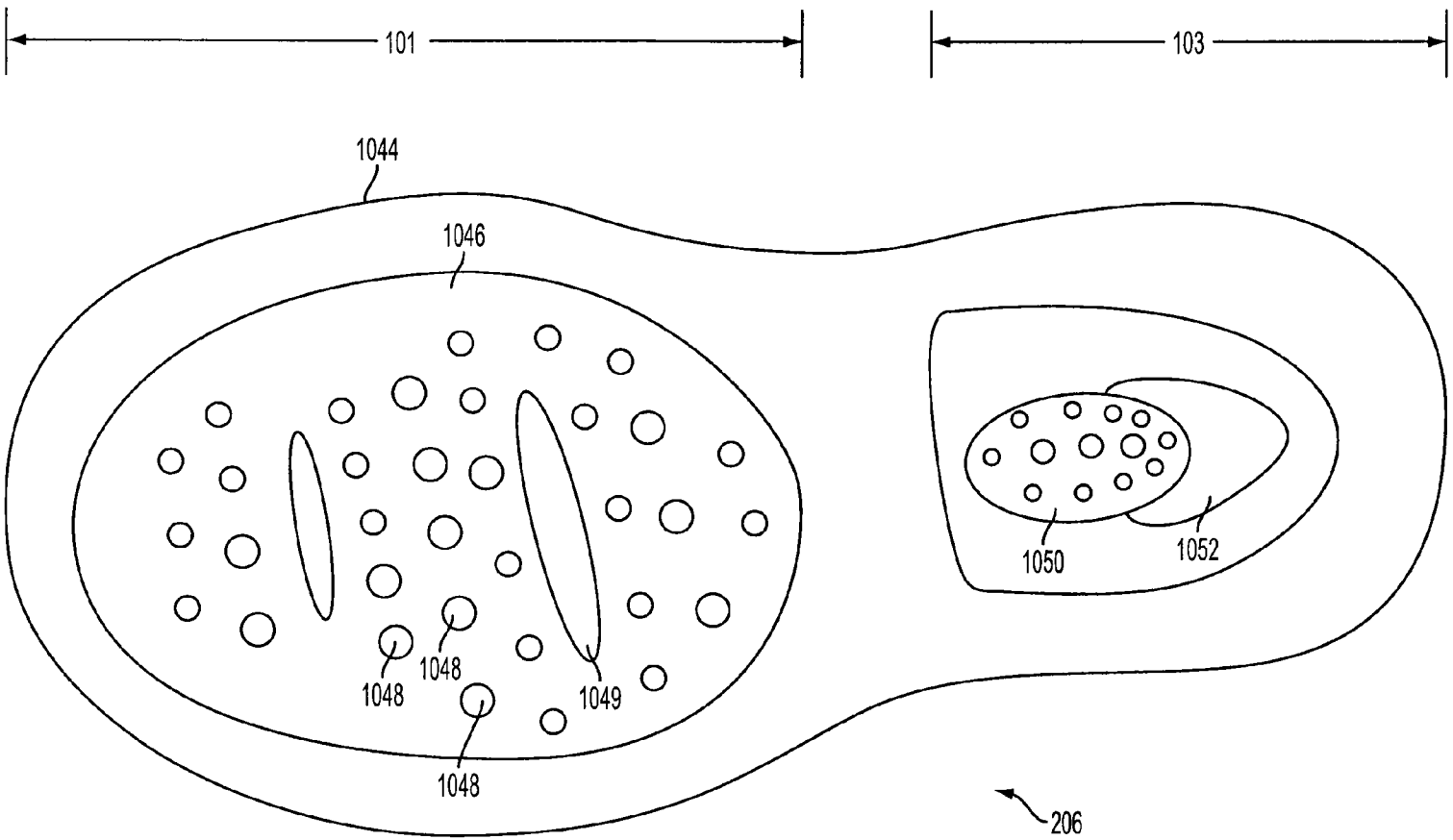
FIG. 10 illustrates a bottom view of an outsole of the sole of FIG. 1.

A more detailed illustration of an outsole 206 is shown in FIG. 10. Outsole 206 forms, in this embodiment, the bottom-most layer of sole 104. Similar to other outsoles known in the art, outsole 206 is generally a ground-engaging interface providing traction for the step. In one embodiment, not shown, outsole 206 is a single piece of generally flat, resilient molded material. In the embodiment shown in FIG. 10, in forefoot region 101 outsole 206 is separated into an exterior portion 1044 and an interior portion 1046. Exterior portion 1044 is made of rubber or a similar resilient, wear-resistent material. Exterior portion 1044 is approximately 1 cm in thickness and ranges from 0.8 cm to 1.5 cm in width. As is well-known in the art, exterior portion 1044 may include tread marks (not shown) for increasing the traction provided by outsole 206.

Interior portion 1046 of outsole 206 is made from the same or a similar material as exterior portion 1044. However, interior portion 1046 is slightly softer and thinner than exterior portion 1044 so that the flexibility of forefoot region 101 is increased. Interior portion 1046 is affixed to exterior portion 1044 by any method known in the art, such as welding, gluing, or co-molding. Alternatively, interior portion 1046 may be attached only to an upper layer of sole 104, such as dispersion plate 208, without being otherwise attached to exterior portion 1044. To further increase the flexibility of forefoot region 101 as well as to reduce the weight of outsole 206, two cutouts 1049 are included in interior portion 1046. As will be recognized by those skilled in the art, the number of cutouts 1049 may be varied or cutouts 1049 may be eliminated entirely in other embodiments.

Disposed on interior portion 1046 are a series of projections 1048. In this embodiment, projections 1048 are generally cylindrical in shape and vary in diameter. All projections 1048 are the same length, and this length is such that projections 1048 protrude slightly beyond the lower surface of exterior portion 1044. Further, projections 1048 are arranged generally in rows somewhat diagonally across interior portion 1046. As will be recognized by those skilled in the art, other shapes or arrangements of projections 1048 are also within the scope of this invention. For example, instead of cylindrical nubs, projections 1048 could be ridges, waves, or the like. Also, the number or positioning of projections 1048 could be altered, e.g., by including fewer but larger cylindrical nubs.

In this embodiment, projections 1048 are integrally molded with interior portion 1046 then coated with the material used for exterior portion 1044. However, as those skilled in the art will recognize, many alternatives are possible. For instance, projections 1048 may be molded entirely separately from outsole 206, then affixed to interior portion 1046 such as by welding, gluing, or heat bonding. Also, other materials may be used for projections 1048. For example, in another embodiment, a harder material than that used for exterior portion 1044 may be used to increase the stiffness of projections 1048.

Projections 1048 serve to provide pressure points in the upper layers of sole 104 to assist in the flexion thereof and/or that can translate through sole 104 to the bottom of the wearer's foot. As the wearer applies pressure to the forefoot, projections 1048 are pressed against the ground. As projection 1048 are relatively stiff, the ground pushes projections 1048 upwards into dispersion plate 208. This additional force helps to increase the amount of bowing of protrusions 522 into receptacles 318 of dispersion plate 208. Additionally, projections 1048 help to prevent the softer material of interior portion 1046 from wearing through, thereby extending the usable life of the shoe.

An interior portion 1050 similar to interior portion 1046 is disposed in heel section 103 to provide some cushioning and massaging effects. Further, a heel cutout 1052 is disposed in the calcaneus region to minimize strike impacts on that region of the heel.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents. All patents and publications discussed herein are incorporated in their entirety by reference thereto.

What is claimed is:

1. A sole for a shoe comprising:

a midsole having at least one protrusion disposed in a forefoot region thereof, wherein said protrusion has one or more diameters; and a plate having at least one receptacle disposed therein, said receptacle having a diameter, said plate placed adjacent to said midsole such that said receptacle aligns with said protrusion, wherein all diameters of said protrusion are greater than the diameter of said receptacle such that only a portion of said protrusion may extend into said receptacle.

2. The sole according to claim 1 further comprising an outsole fixedly attached to said plate and said midsole, wherein said outsole is disposed along the entire length of the shoe.

3. The sole according to claim 2, wherein a forefoot region of said outsole includes an exterior portion having a first hardness and an interior portion having a second hardness.

4. The sole according to claim 3, wherein said first hardness is greater than said second hardness.

5. The sole according to claim 3, wherein at least one cutout is disposed in said interior portion.

6. The sole according to claim 3, wherein at least one projection is disposed on said interior portion.

7. The sole according to claim 2, wherein at least one projection is disposed in a forefoot region of said outsole.

8. The sole according to claim 1, further comprising a sockliner having at least one nub disposed in a forefoot region on a lower surface thereof, wherein said sockliner is placed on top of said midsole with said nub facing said midsole.

9. The sole according to claim 8, wherein an abrasion-resistant material is attached to an upper surface of said sockliner.

10. The sole according to claim 9, wherein said abrasion-resistant material has absorbant properties.

11. The sole according to claim 1, further including a stiff board disposed in an arch region of said sole.

12. The sole according to claim 1, wherein said plate is fixedly attached to said midsole.

13. The sole according to claim 1, wherein said plate is fixedly attached to an outsole.

14. The sole according to claim 1, further comprising a cutout in said midsole, wherein said protrusion is disposed in said cutout.

15. The sole according to claim 14, wherein said protrusion is disposed in said cutout such that an outward-most extremity of said protrusion approximately aligns with an outward-most surface of said midsole.

16. An outsole for increasing circulation in a wearer's foot for use in a multi-layered sole comprising:

a generally flat portion, wherein said flat portion includes an exterior portion and a softer interior portion; and at least one projection extending outwards from said interior portion in a forefoot region of said outsole, wherein pressure on the forefoot region from the wearer's foot causes said projection to press against a ground surface and deflect upwards into a soft upper layer of the sole, adjacent the wearer's forefoot.

17. The outsole according to claim 16, further comprising a cutout disposed in said flat portion.

18. A method for increasing circulation in a wearer's forefoot comprising:

providing a sole having a first layer with at least one protrusion disposed in a forefoot region thereof, wherein said protrusion has one or more diameters and a second layer having at least one receptacle therein said receptacle having a diameter, wherein all diameters of said protrusion are greater than said diameter of said receptacle, wherein said second layer abuts said first layer such that said receptacle aligns with said protrusion;

applying pressure to the forefoot region of said sole, thereby forcing said protrusion and said receptacle together; and deflecting only a portion of said protrusion into said receptacle, thereby reducing pressure in the wearer's forefoot in the immediate vicinity of said protrusion.

19. The method for increasing circulation in a wearer's forefoot according to claim 18, wherein the diameter of said receptacle is not greater than the diameter of said protrusion.

20. The method for increasing circulation in a wearer's forefoot according to claim 18, further comprising:

providing a sockliner having nubs in a forefoot region thereof extending outwards from a surface thereof; and applying pressure to the forefoot region of said sole, thereby forcing said nubs into in the wearer's forefoot, creating massaging pressure points.

21. The method for increasing circulation in a wearer's forefoot according to claim 18, further comprising:

providing an outsole having a generally flat soft surface from which a relatively stiff projection extends; and applying pressure to the forefoot region of said sole, thereby forcing said projection upwards, increasing the deflection of said protrusion into said receptacle.

22. A sole for a shoe comprising:

a midsole having at least one protrusion disposed in a forefoot region thereof, wherein said protrusion has one or more diameters;

a plate having at least one receptacle disposed therein, said receptacle having a diameter, said plate placed adjacent to said midsole, wherein said receptacle aligns with said protrusion and wherein all diameters of said protrusion are greater than said diameter of said receptacle such that only a portion of said protrusion may extend into said receptacle; and an outsole, wherein said outsole is disposed on an exterior surface of said shoe sole and wherein said plate is disposed between said midsole and said outsole.

23. A sole for a shoe comprising:

a midsole having at least one protrusion disposed in a forefoot region thereof, wherein said protrusion has an outward-most surface; and a plate having at least one receptacle disposed therein, said plate placed adjacent to said midsole such that said receptacle aligns with said protrusion, wherein a diameter of said receptacle is not greater than a diameter of said outward-most surface of said protrusion such that only a portion of said outward-most surface of said protrusion may extend through said receptacle; and an outsole fixedly attached to said plate and said midsole, wherein said outsole is disposed along the entire length of the shoe, wherein a forefoot region of said outsole includes an exterior portion having a first hardness and an interior portion having a second hardness.

24. The sole according to claim 23, wherein said first hardness is greater than said second hardness.

25. The sole according to claim 23, wherein at least one cutout is disposed in said interior portion.

26. The sole according to claim 23, wherein at least one projection is disposed on said interior portion.

27. A method for increasing circulation in a wearer's forefoot comprising:

providing a sole having a first layer with at least one protrusion disposed in a forefoot region thereof, wherein said protrusion has an outward-most surface and a second layer having at least one receptacle therein, wherein said second layer abuts said first layer such that said receptacle aligns with said protrusion;

applying pressure to the forefoot region of said sole, thereby forcing said outward-most surface of said protrusion and said receptacle together;

deflecting only a portion of said outward-most surface of said protrusion into said receptacle, thereby reducing pressure in the wearer's forefoot in the immediate vicinity of said protrusion;

providing an outsole having a generally flat soft surface from which a relatively stiff projection extends; and applying pressure to the forefoot region of said sole, thereby forcing said projection upwards, increasing the deflection of said protrusion into said receptacle.

* * * * *